US011865398B1

(12) United States Patent
Parvarandeh et al.

(10) Patent No.: US 11,865,398 B1
(45) Date of Patent: Jan. 9, 2024

(54) EXERCISE EQUIPMENT

(71) Applicants: Pirooz Parvarandeh, Los Altos, CA (US); Violet Parvarandeh, Los Altos, CA (US); Bobak Parvarandeh, Los Altos, CA (US)

(72) Inventors: Pirooz Parvarandeh, Los Altos, CA (US); Violet Parvarandeh, Los Altos, CA (US); Bobak Parvarandeh, Los Altos, CA (US)

(73) Assignee: i.Clarity Innovations, Los Altos, CA (US)

( * ) Notice: Subject to any disclaimer, the term of this patent is extended or adjusted under 35 U.S.C. 154(b) by 0 days.

(21) Appl. No.: 17/443,758

(22) Filed: Jul. 27, 2021

Related U.S. Application Data

(60) Provisional application No. 63/059,759, filed on Jul. 31, 2020.

(51) Int. Cl.

| | |
|---|---|
| ***A63B 21/078*** | (2006.01) |
| ***A63B 21/00*** | (2006.01) |
| ***A63B 21/04*** | (2006.01) |
| ***A63B 21/055*** | (2006.01) |

(52) U.S. Cl.
CPC ..... *A63B 21/078* (2013.01); *A63B 21/0442* (2013.01); *A63B 21/0552* (2013.01); *A63B 21/4033* (2015.10); *A63B 2210/50* (2013.01)

(58) Field of Classification Search
CPC ..... A63B 21/078; A63B 21/0442; A63B 21/0552; A63B 21/4033; A63B 2210/50
See application file for complete search history.

(56) References Cited

U.S. PATENT DOCUMENTS

| | | | | |
|---|---|---|---|---|
| 7,364,530 | B2 * | 4/2008 | Lopez | A63B 21/00047 482/38 |
| 7,410,450 | B1 * | 8/2008 | Paulding | A63B 21/1609 482/121 |
| 7,591,763 | B1 * | 9/2009 | Fucci | A63B 21/4013 482/52 |
| 8,715,144 | B1 * | 5/2014 | Friess | A63B 21/4033 482/121 |
| 2004/0067828 | A1 * | 4/2004 | Croft | A63B 21/023 482/123 |
| 2004/0176227 | A1 * | 9/2004 | Endelman | A63B 22/203 482/142 |

(Continued)

FOREIGN PATENT DOCUMENTS

| | | | | |
|---|---|---|---|---|
| WO | WO-2008010797 | A1 * | 1/2008 | A63B 22/0605 |

*Primary Examiner* — Andrew S Lo
(74) *Attorney, Agent, or Firm* — Haverstock & Owens, A Law Corporation

(57) ABSTRACT

An exercise equipment has a structure that can be easily collapsed for storage, and that provides improved utility due to its multiple functional capabilities and configurations thereby enabling a comprehensive set of strength exercises. The exercise equipment includes a rigid base structure that can be folded into compact form when not in use and can be configured for accessories that attach to the base structure. The exercise equipment with attached accessories combines heretofore separate pieces of equipment into one that covers a fraction of the floor space of all such separate pieces of equipment. This provides exercise equipment that is more flexible, more functional, and has a smaller footprint, all of which can be folded up for compact storage.

38 Claims, 15 Drawing Sheets

(56) References Cited

U.S. PATENT DOCUMENTS

| | | | | |
|---|---|---|---|---|
| 2015/0038304 | A1* | 2/2015 | Davenport | A63B 23/1218 482/123 |
| 2016/0296785 | A1* | 10/2016 | Kamins | A63B 69/0062 |
| 2016/0354629 | A1* | 12/2016 | Salamon | A63B 23/03508 |
| 2018/0008857 | A1* | 1/2018 | Barber | A63B 21/0428 |
| 2018/0236289 | A1* | 8/2018 | Allen | A63B 21/0552 |
| 2019/0111302 | A1* | 4/2019 | Ballestero | A63B 21/00061 |
| 2019/0329095 | A1* | 10/2019 | Noren | A63B 21/068 |
| 2020/0114194 | A1* | 4/2020 | McGhee | A63B 21/169 |
| 2021/0016130 | A1* | 1/2021 | Cope | A63B 21/4029 |
| 2021/0346750 | A1* | 11/2021 | Reed, III | A63B 21/0552 |
| 2021/0402248 | A1* | 12/2021 | Clark | A63B 21/0442 |

* cited by examiner

EXERCISE EQUIPMENT

RELATED APPLICATIONS

This Patent application claims priority under 35 U.S.C. 119(e) of the co-pending U.S. provisional patent application, Application Ser. No. 63/059,759, filed on Jul. 31, 2020, and entitled "Exercise Equipment", which is hereby incorporated in its entirety by reference.

FIELD OF THE INVENTION

The present invention is generally directed to exercise equipment. More specifically, the present invention is directed to exercise equipment that is reconfigurable into multiple different positions for enabling a user to perform a variety of different exercises and for storing in a compact size.

BACKGROUND OF THE INVENTION

Exercise equipment provides user's with enhanced means for performing physical activities, typically for the purpose of improving the user's physical strength and/or conditioning. Many such exercise equipment provides fixed or adjustable amounts of resistance, such as weight machines, or to otherwise enhance the experience or outcome of an exercise routine, such as stationary bikes or rowing machines. Exercise equipment is often fixed in place and occupies a substantial floor space, and can be limited in the number of exercises that can be performed. An exercise routine comprising a number of different exercises may necessitate the use of multiple different exercise equipment. Although plausible in a gym setting, use of multiple different exercise equipment may not be feasible in a user's home, due at least in part to space and cost constraints.

SUMMARY OF THE INVENTION

Embodiments are directed to exercise equipment having a structure that can be easily collapsed for storage, and that provides improved utility due to its multiple functional capabilities and configurations thereby enabling a comprehensive set of strength exercises. The exercise equipment includes, but is not limited to, a rigid base structure that can be folded into compact form when not in use and can be configured for accessories that attach to the base structure. The exercise equipment can also include electronics that are attached to the accessories, communications means between the electronics and an external electronic device, such as a cell phone, the external electronic device and an app (software application) that runs on the electronic device, and a communications network, such as a cloud-based network. The exercise equipment with attached accessories combines heretofore separate pieces of equipment into one, that covers a fraction of the floor space as all separate pieces of equipment. This provides exercise equipment that is more flexible, more functional, and has a smaller footprint, all of which can be folded up for compact storage.

In an aspect, exercise equipment is disclosed. The exercise equipment comprises a base platform, a plurality of base platform hinge assemblies, and a collapsible frame. The base platform comprises a plurality of base platform fastener sites configured for attaching an exercising accessory to the base platform. The plurality of base platform hinge assemblies are coupled to an end of the base platform. The collapsible frame is coupled to the base platform hinge assemblies, wherein the collapsible frame comprises a plurality of frame fastener sites configured for attaching the exercising accessory to the collapsible frame. The plurality of base platform hinge assemblies are configured to move the collapsible frame and the base platform relative to each other and between a folded configuration for storage of the exercise equipment and an unfolded configuration for performing exercises by a user. In some embodiments, the base platform comprises a planar substrate configured to lie on a flat surface. In some embodiments, the base platform comprises rigid rail structure positioned along a perimeter of the planar substrate. In some embodiments, the rigid rail structure is positioned along three sides of the planar substrate. In other embodiments, the rigid rail structure circumnavigates an entire perimeter of the planar substrate. In some embodiments, the base platform fastener sites are formed in the rigid rail structure. In some embodiments, the collapsible frame comprises a plurality of frame sections interconnected by a plurality of frame hinge assemblies. In some embodiments, the plurality of frame hinge assemblies are configured to move the frame sections relative to each other and between the folded configuration and the unfolded configuration, wherein in the folded configuration the plurality of frame sections are folded upon each other. In some embodiments, the plurality of frame sections comprise a first frame section coupled to the base platform via the plurality of base platform hinge assemblies, a second frame section coupled to the first frame section via a first subset of the plurality of frame hinge assemblies, and a third frame section coupled to the second frame section via a second subset of the plurality of frame hinge assemblies. In some embodiments, in the unfolded configuration the first frame section and the second frame section are perpendicular to the base platform, and the third frame section is one of either perpendicular to the base platform, parallel to the base platform, or angled to the base platform. In some embodiments, the exercise equipment further comprises a support member configured to attach to a fastener site on the third frame section and a fastener site of the second frame section when the third frame section is positioned either perpendicular to the base platform or angled to the base platform. In some embodiments, the exercising accessory is attached to either the base platform via one or more of the plurality of base platform fastener sites, the collapsible frame via one or more of the plurality of frame fastener sites, or both the base platform via one or more of the plurality of base platform fastener sites and the collapsible frame via one or more of the plurality of frame fastener sites. In some embodiments, the exercise equipment further comprises a fastener configured to removably fasten and unfasten at each of the plurality of fastener sites, wherein the fastener includes a first fastener element configured to mate with a complementary fastener element at the fastener site and a second fastener element configured to mate with a complementary fastener element on the exercising accessory. In some embodiments, an attachment position of the exercising accessory on the base platform is adjustable by selectively attaching the fastener to one of the plurality of base platform fastener sites. In some embodiments, an attachment position of the exercising accessory on the collapsible frame is adjustable by selectively attaching the fastener to one of the plurality of frame fastener sites. In some embodiments, the exercise equipment further comprises a fastener configured to removably fasten and unfasten at each of the plurality of fastener sites, wherein the fastener includes a first fastener element configured to mate with a complementary fastener element at the fastener site and a pulley. In some embodiments, the exercise equipment further comprises a plurality of wheels coupled to the base platform, wherein in the unfolded configuration the wheels do not contact the ground, and in the folded configuration the wheels enable the exercise equipment to be moved to a storage location. In some embodiments, the exercise equipment further comprises a crankshaft coupled to the base platform that when positioned in a vertical storage position enables the folded base platform to be lowered to a horizontal position. In some embodiments, the exercising accessory comprises a resistance band. In some embodiments, the exercising accessory comprises a back rest. In some embodiments, the exercising accessory comprises a back rest with arm bars. In some embodiments, the exercising accessory comprises a stationary bike. In some embodiments, the exercise equipment further comprises a plurality of exercising accessories, each one of the plurality of exercising accessories attached to either the base platform via one or more of the plurality of base platform fastener sites, the collapsible frame via one or more of the plurality of frame fastener sites, or both the base platform via one or more of the plurality of base platform fastener sites and the collapsible frame via one or more of the plurality of frame fastener sites. In some embodiments, the plurality of exercising accessories comprise a plurality of resistance bands, further comprising a moveable element coupled to the plurality of resistance bands. In some embodiments, the plurality of resistance bands are attached at different angles to the moveable element to enable multi-directional force vectors applied to the moveable element. In some embodiments, the moveable element comprises a bar or a slidable seat.

BRIEF DESCRIPTION OF THE DRAWINGS

Several example embodiments are described with reference to the drawings, wherein like components are provided with like reference numerals. The example embodiments are intended to illustrate, but not to limit, the invention. The drawings include the following figures.

DETAILED DESCRIPTION OF THE EMBODIMENTS

Figure 4:
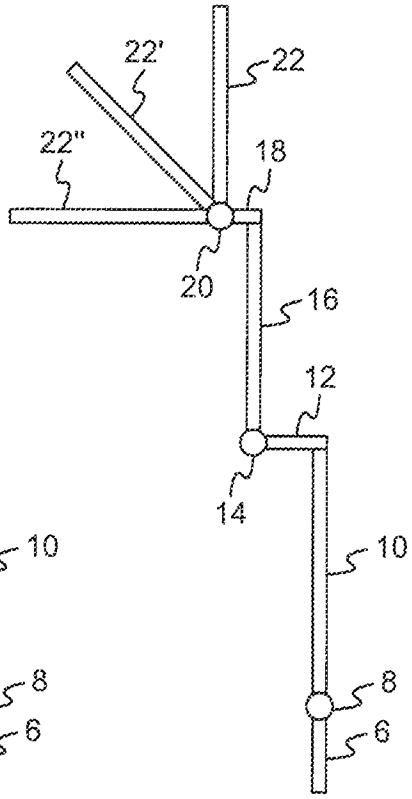
FIG. 4 illustrates a side view of the base structure in an unfolded configuration according to some embodiments.

Embodiments of the present application are directed to exercise equipment. Those of ordinary skill in the art will realize that the following detailed description of exercise equipment is illustrative only and is not intended to be in any way limiting. Other embodiments of exercise equipment will readily suggest themselves to such skilled persons having the benefit of this disclosure.

Reference will now be made in detail to implementations of the exercise equipment as illustrated in the accompanying drawings. The same reference indicators will be used throughout the drawings and the following detailed description to refer to the same or like parts. In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

The base structure of the exercise equipment includes a base platform onto which the user stands, squats, kneels, or otherwise bears their weight. In some embodiments, the base platform comprises a solid planar substrate, such as a rectangular board. The base structure also includes a frame attached at one side of the base platform. The base platform is configured to firmly attach to the frame. In some embodiments, the frame is a scaffolding structure with multiple hinged frame sections. The base structure is enabled for a folded configuration and an unfolded configuration. The frame is configured to be unfolded to lock into a "vertical" structure. The base platform stabilizes the "vertical" structure from toppling over. The base platform is also designed to allow a footprint of the frame to be expanded. The larger the footprint of the base platform, the more stable the overall base structure.

In the folded configuration, the base structure forms a compact volume for convenient storage. In the unfolded configuration, the base structure has a work out area where the user is positioned within a footprint of the base platform. In this manner, when the user is performing an exercise the user's center of mass is vertically aligned over a footprint of the base platform. This provides internal support for the exercise equipment without need of external support means. The weight of the user on the base platform, either directly by standing, squatting, kneeling, or the like on the base platform, or indirectly by the user bearing their weight on a bench, chair, accessory, or the like positioned on the base platform, maintains and stabilizes the exercise equipment in place during performance of an exercise. Dimensions of the base platform, e.g. length and width, are designed according to the composite range of motions of the various exercises to be performed and to ensure that the user's center of mass is maintained within the base platform footprint while performing the exercises. In some embodiments, the solid planar substrate can be slidably removed and replaced with a longer solid planar substrate that increases the length, and therefore the footprint, of the base platform. In other embodiments, the end of the solid planar substrate distal from the frame is configured to enable attachment of an additional solid planar substrate to increase the length of the base platform.

Fastener sites can be located along the base platform and the frame, including any perimeter and cross members. In this manner, connection points (at each fastener site) can be established at most any position on the base structure. Fastener sites are used to connect accessories for performing exercises. Accessories include, but are not limited to, resistance bands, also referred to as tension bands, which can be used to create resistance in a variety of different exercises. The fastener sites are also configured for attachment of other types of accessories, as described below. In some embodiments, such accessories can include additional frame pieces, each with their own one or more fastener sites. Each such frame piece with fastener sites accessory can be mounted to any frame section and/or base platform to provide additional fastener sites. In this manner, frame piece with fastener sites accessories enable a user to manipulate a fastener site(s) in a variety of X, Y (plane of the base platform) and/or X, Z (plane of the frame) locations.

Figure 1:
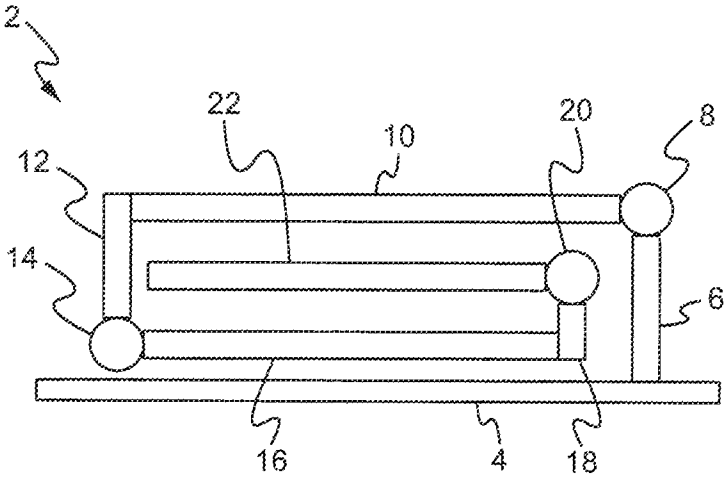
FIG. 1 illustrates a side view of a conceptual block diagram of the base structure in the folded configuration according to some embodiments.

FIG. 1 illustrates a side view of a conceptual block diagram of the base structure in the folded configuration according to some embodiments. The folded base structure can be stored in either a horizontal position, as shown in FIG. 1, or a vertical position (not shown). The folded base structure can include wheels for moving the folded base structure into and out of a storage location. The wheels can be configured with multiple degrees of movement for improved maneuverability when the base structure is folded up. The wheels would not contact the ground in the unfolded configuration, but when folded can be used to move the folded base structure. To unfold the base structure 2 into a usable form, the folded base structure 2 is positioned with the base platform 4 resting on the ground. The frame includes a first frame section 10, a second frame section 16, and a third frame section 22. The first frame section 10 is connected to the base platform 4 via a pair of hinge assemblies 8. The side view shown in FIG. 1 only shows one hinge assembly 8 of the pair of hinge assemblies 8 (see FIG. 5, for example, for both hinge assemblies in the pair). A mounting frame section 6 enables securing of the base platform 4 to the hinge assemblies 8 and can be considered a portion of either the base platform 4 or the hinge assemblies 8 depending on the specific implementation and mounting means. The second frame section 16 is connected to the first frame section 10 via a pair of hinge assemblies 14. A mounting frame section 12 enables securing of the first frame section 10 to the hinge assembly 14 and can be considered a portion of either the first frame section 10 or the hinge assembly 14 depending on the specific implementation and mounting means. The third frame section 22 is connected to the second frame section 16 via a hinge assembly 20. A mounting frame section 12 enables securing of the first frame section 10 to the hinge assembly 20 and can be considered a portion of either the second frame section 16 or the hinge assembly 20 depending on the specific implementation and mounting means.

Figure 3:
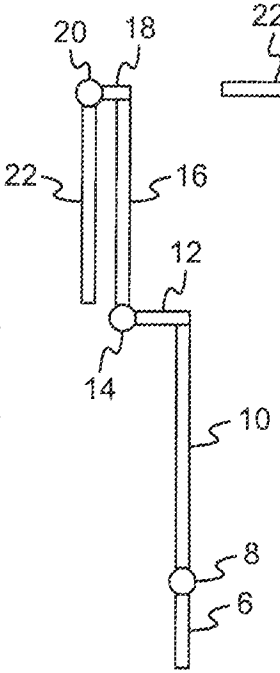
FIG. 3 illustrates a side view of the base structure in a partially unfolded configuration according to some embodiments.
Figure 2:
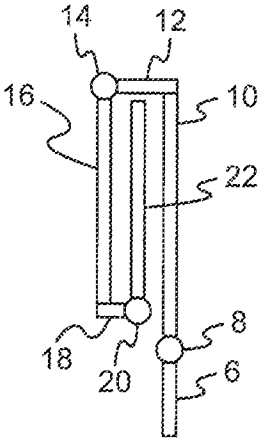
FIG. 2 illustrates a side view of the base structure in a partially unfolded configuration according to some embodiments.

A first pair of latches is unlatched for releasing the folded frame from its locked storage position, thereby enabling a first frame section 10 to be rotated to a first upright position, as shown in FIG. 2, where the first frame section 10 is re-locked into place. The first pair of latches are co-located with the pair of hinge assemblies 8 and are generally shown as element 8. In some embodiments, the first upright position corresponds to the first frame section 10 being perpendicular to the base platform 4. A second pair of latches is unlatched for releasing the second frame section 16, thereby enabling the second frame section 16 to be unlocked from a folded position and rotated from the folded position relative to the first frame section 10. The second frame section 16 is rotated into a second upright position, as shown in FIG. 3, where the second frame section 16 is re-locked into place. The second pair of latches are co-located with the pair of hinge assemblies 14 and are generally shown as element 14. Although FIG. 3 shows the second frame section 16 in a different vertical plane than the first frame section 10 due to the alignment of the mounting frame section 12, it is understood that the mounting frame section 12 can be alternatively configured, such as aligned inline with the first frame section 10 as opposed to the perpendicular alignment shown, such that the second frame section 16 is inline with the first frame section 10. In this case, the second upright position corresponds to both the first and second frame sections being inline with each other and perpendicular to the base platform. A third pair of latches is unlatched for releasing the third frame section 22, thereby enabling the third frame section 22 to be unlocked from the folded position and rotated from the folded position relative to the second frame section 16. The third pair of latches are co-located with the pair of hinge assemblies 20 and are generally shown as element 20. The third frame section 22 is rotated into one or multiple possible positions relative to the second frame section 16, as shown in FIG. 4, where the third frame section 22 is re-locked into place. The range of possible positions of the third frame section ranges from 0-180 degrees relative to the second piece of frame. FIG. 4 shows three different possible locked positions for the third frame section 22. A first position is in the vertical position, shown as third frame section 22, a second position is in a 45 degree angles position, shown as third frame section 22', and a third position is in the horizontal position, shown as third frame section 22". It is understood that the mounting frame section 18 can be alternatively configured, such as aligned inline with the second frame section 16 as opposed to the perpendicular alignment shown, such that the third frame section 22 is inline with the second frame section 10, when the third frame section 22 is in the vertical position. In this case, the vertical position corresponds to both the second and third frame sections being inline with each other and perpendicular to the base platform. A first end of the third frame section 22 is connected via the third pair of latches to an end of the second frame section 16. A distal second end of the third frame section 22 is unsupported. An example use of the second end of the third frame section 22 can be as a pull-up bar.

Figure 5:
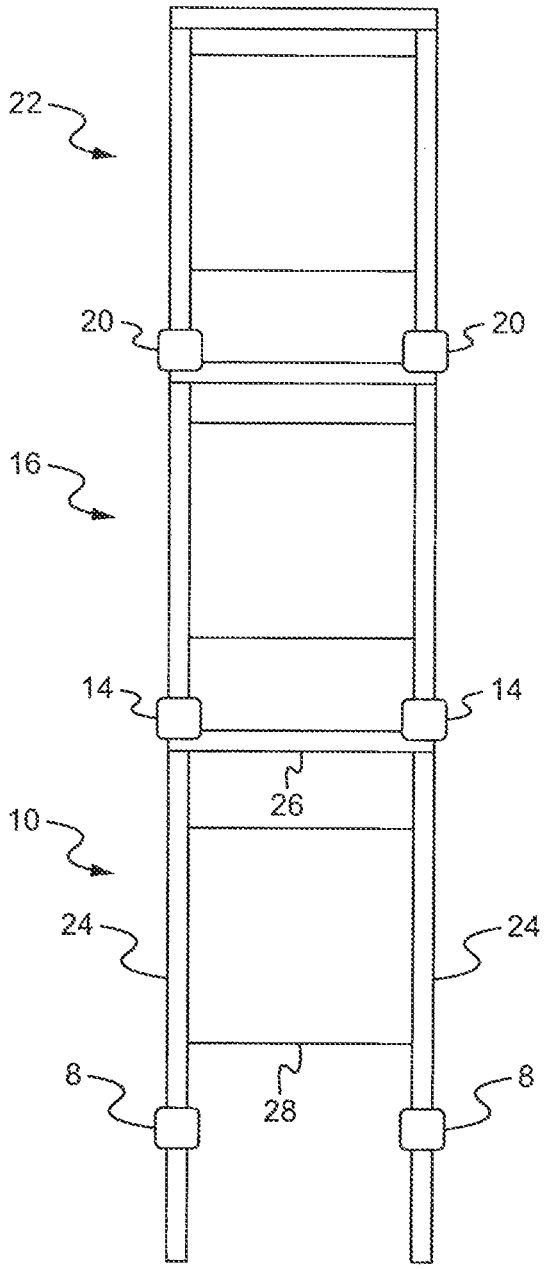
FIG. 5 illustrates a side view of the frame according to some embodiments.
Figure 6:
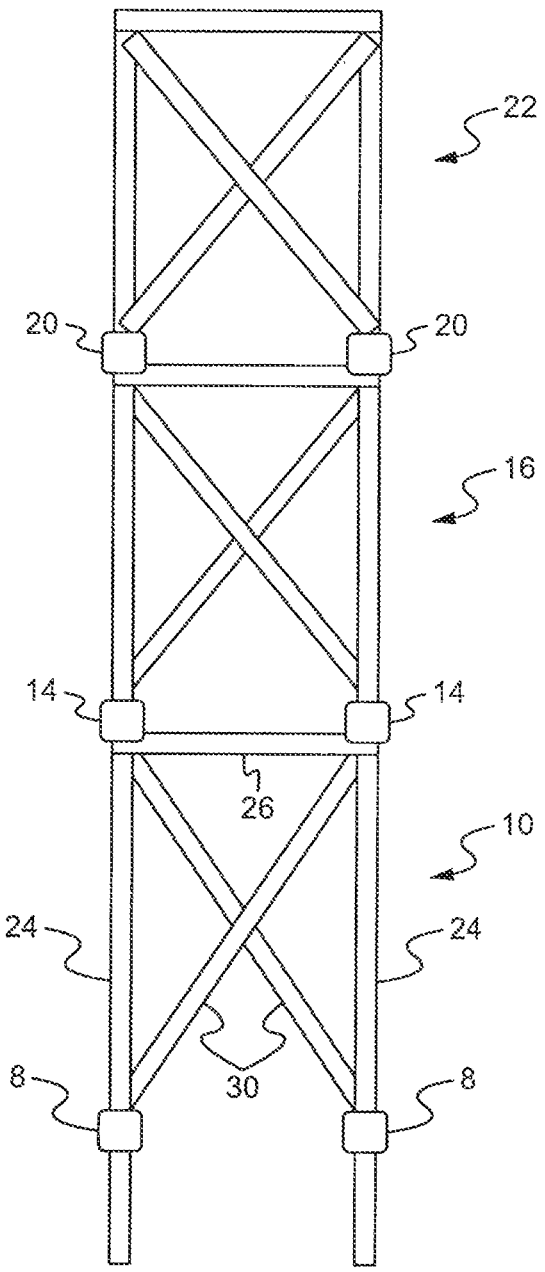
FIG. 6 illustrates a side view of the frame according to other embodiments.

Various configurations can be used to provide lateral stability to the frame sections. FIG. 5 illustrates a side view of the frame according to some embodiments. The view shown in FIG. 5 is rotated 90 degrees about vertical axis from the view shown in FIGS. 1-4. The frame configuration shown in FIG. 5 has the first frame section 10 including vertical supports 24 and horizontal support 26. A planar support sheet 28, such as a metal sheet, connects the vertical supports 24. The second frame section 16 and the third frame section 22 can be similarly configured. Each member 24, 26, 28 of each frame section can be configured with one or more fastener sites, as described in greater detail below, that enable connection of resistance bands or other accessories. Alternatively to the planar support sheet, a cross-bar configuration using cross-bars 30 can be used, as shown in FIG. 6. The cross-bars 30 also can be configured with one or more fastener sites. It is understood that alternative configurations can be used to provide lateral stability to the frame and frame sections.

Figure 7:
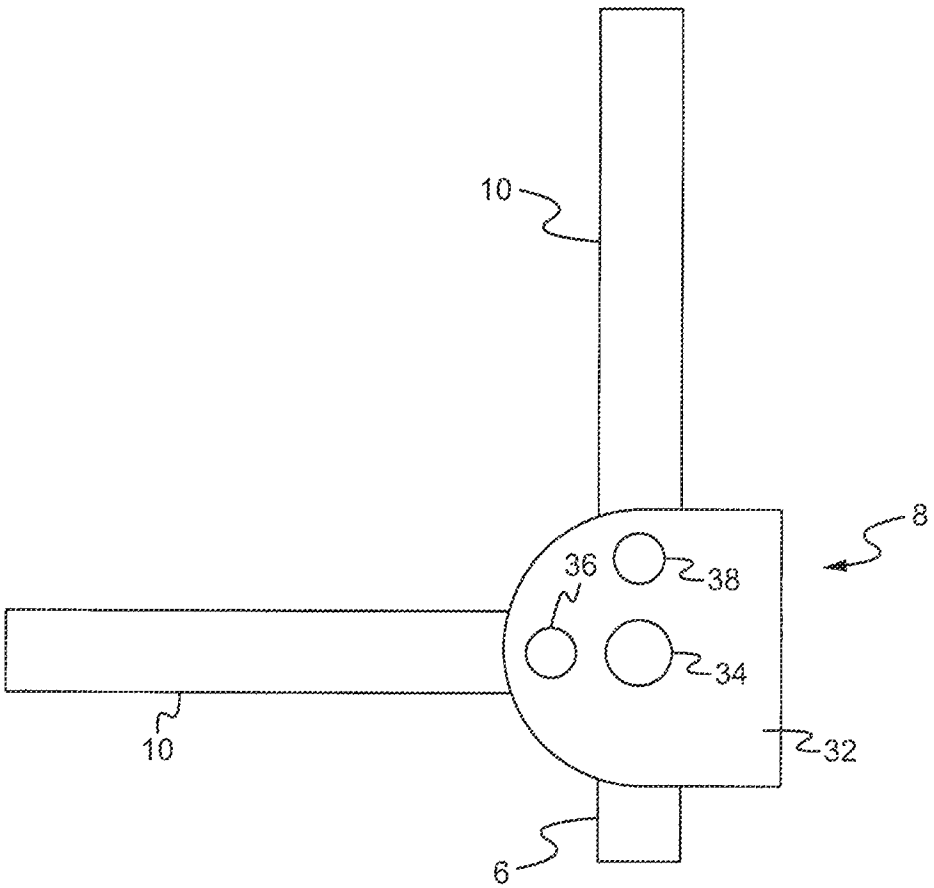
FIG. 7 illustrates a side view of the frame and an expanded view of the hinge assembly used to connect the base platform to the first frame section according to some embodiments.
Figure 7:
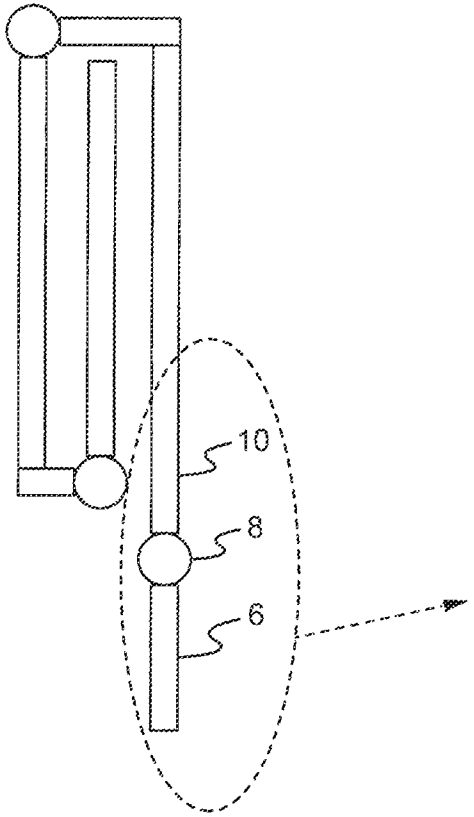
Figure 8:
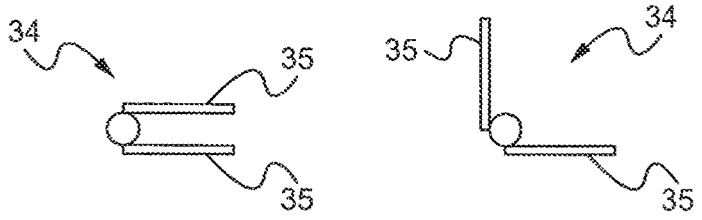
FIG. 8 illustrates an exemplary hinge having two leafs that can be rotated relative to each other according to some embodiments.
Figure 9:
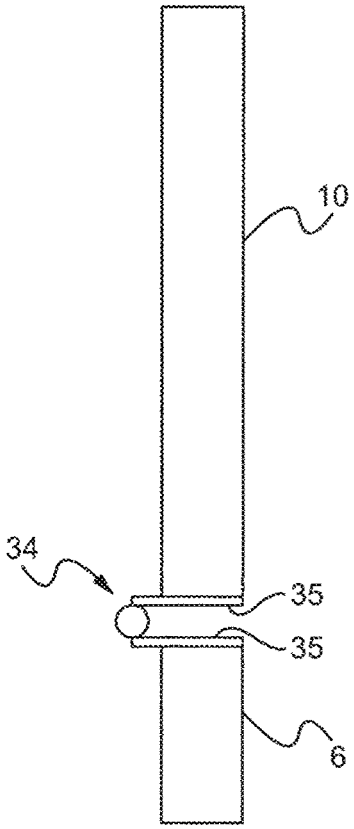
FIG. 9 illustrates the hinge where the first frame section is rotated to the second position.
Figure 10:
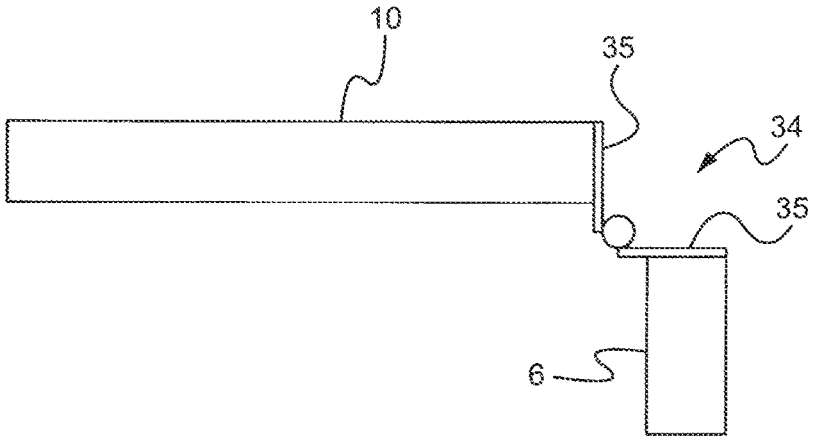
FIG. 10 illustrates the hinge where the first frame section is rotated to the first position.

In general, the hinge assemblies are of any type capable of folding and unfolding the base platform and frame sections, as well as locking and un-locking the frame sections in various positions, as described above. The specific types of hinge assemblies used for each interconnection point can vary depending on the degrees of movement and the various locking positions intended. FIG. 7 illustrates a side view of the frame and an expanded view of the hinge assembly used to connect the base platform 6 to the first frame section 10 according to some embodiments. FIG. 7 shows two different possible locked positions for the first frame section 10. A first position corresponds to a folded configuration, such as that shown in FIG. 1. The first position corresponds to the horizontally aligned first frame section 10 shown in FIG. 7. A second position corresponds to an unfolded configuration, such as those shown in FIGS. 2-4. The second position corresponds to the vertically aligned first frame section 10 shown in FIG. 7. The exemplary hinge assembly 8 includes a mounting plate 32 and a hinge 34. The hinge 34 enables the first frame section 10 to rotate relative to the mounting frame section 6. The hinge 34 can be configured as any conventional type of hinge that enables such relative movement, such as a barrel hinge that includes a pin, knuckles, and leafs. The mounting plate 32 includes through-holes 36 and 38, which when properly aligned with a corresponding through-hole in the first frame section 10 enable a pin to be inserted to lock the first frame section 10 in the first position or the second position, respectively. The mounting plate 32 is shown as a semi-circle on one side and a rectangle on the other side. It is understood that alternative configurations can be used. The mounting frame section 6 is fixedly mounted to the mounting plate 32, such as by welding. The hinge 34 is fixedly mounted to the mounting frame section 6 and to the first frame section 10, such as by welding. FIG. 8 illustrates an exemplary hinge having two leafs 35 that can be rotated relative to each other. One leaf 35 can be fixedly mounted to the mounting frame section 6 and the other leaf 35 can be fixedly mounted to first frame section 10. FIG. 9 illustrates the hinge 34 where the first frame section 10 is rotated to the second position. FIG. 10 illustrates the hinge 34 where the first frame section 10 is rotated to the first position.

Figure 11:
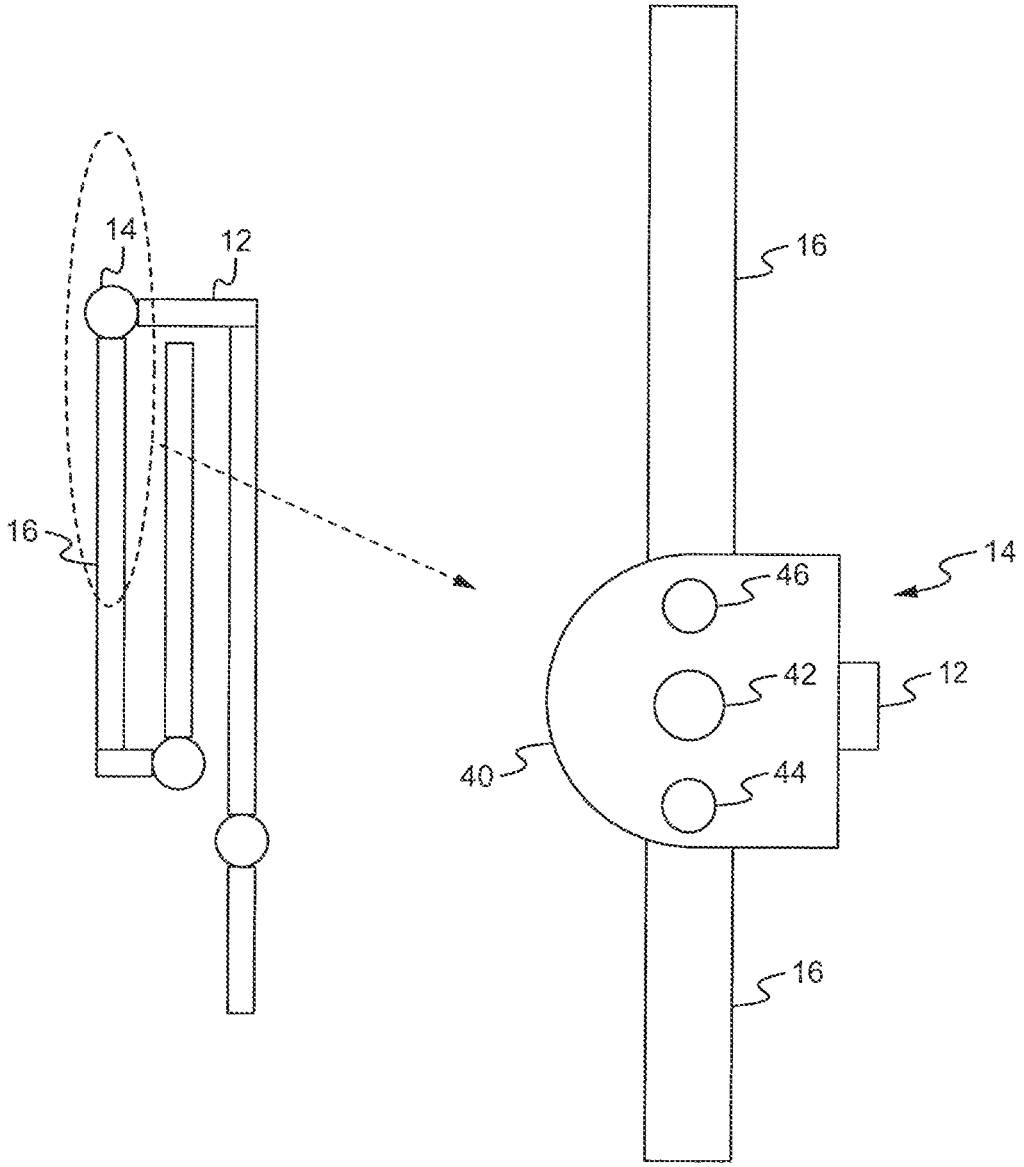
FIG. 11 illustrates a side view of the frame and an expanded view of the hinge assembly used to connect the first frame section to the second frame section according to some embodiments.
Figure 12:
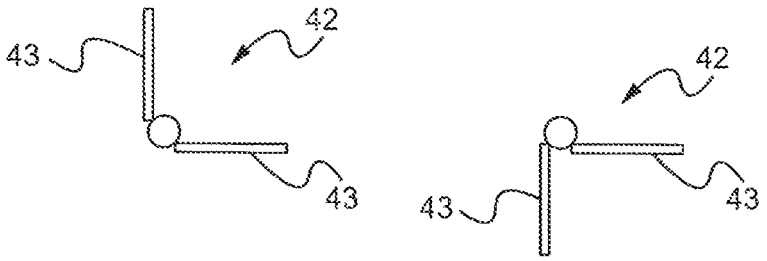
FIG. 12 illustrates an exemplary hinge having two leafs that can be rotated relative to each other.
Figure 13:
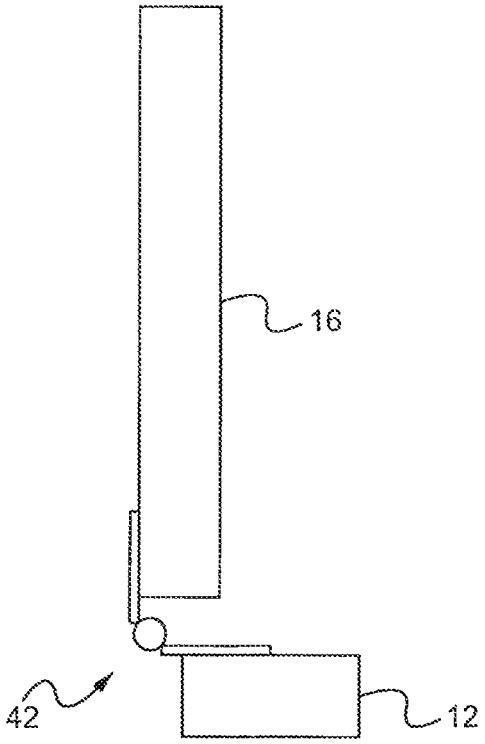
FIG. 13 illustrates the hinge where the second frame section is rotated to the second position.
Figure 14:
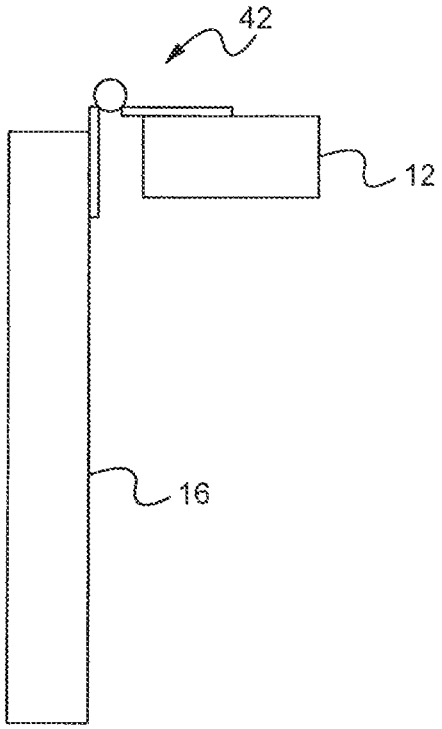
FIG. 14 illustrates the hinge where the second frame section is rotated to the first position.

FIG. 11 illustrates a side view of the frame and an expanded view of the hinge assembly used to connect the first frame section 10 to the second frame section 16 according to some embodiments. FIG. 11 shows two different possible locked positions for the second frame section 16. A first position corresponds to a folded configuration, such as that shown in FIGS. 1-2. The first position corresponds to the lower second frame section 16 shown in the right hand side of FIG. 11. A second position corresponds to an unfolded configuration, such as those shown in FIGS. 3-4. The second position corresponds to the upper second frame section 16 shown in the right hand side in FIG. 11. The exemplary hinge assembly 14 includes a mounting plate 40 and a hinge 42. The hinge 42 enables the second frame section 16 to rotate relative to the mounting frame section 12. The hinge 42 can be configured as any conventional type of hinge that enables such relative movement, such as a barrel hinge that includes a pin, knuckles, and leafs. The mounting plate 40 includes through-holes 44 and 46, which when properly aligned with a corresponding through-hole in the second frame section 16 enable a pin to be inserted to lock the second frame section 16 in the first position or the second position, respectively. The mounting plate 40 is shown as a semi-circle on one side and a rectangle on the other side. It is understood that alternative configurations can be used. The mounting frame section 12 is fixedly mounted to the mounting plate 40, such as by welding. The hinge 42 is fixedly mounted to the mounting frame section 12 and to the second frame section 16, such as by welding. FIG. 12 illustrates an exemplary hinge having two leafs 43 that can be rotated relative to each other. One leaf 43 can be fixedly mounted to the mounting frame section 12 and the other leaf 35 can be fixedly mounted to second frame section 16. FIG. 13 illustrates the hinge 42 where the second frame section 16 is rotated to the second position. FIG. 14 illustrates the hinge 42 where the second frame section 16 is rotated to the first position.

Figure 15:
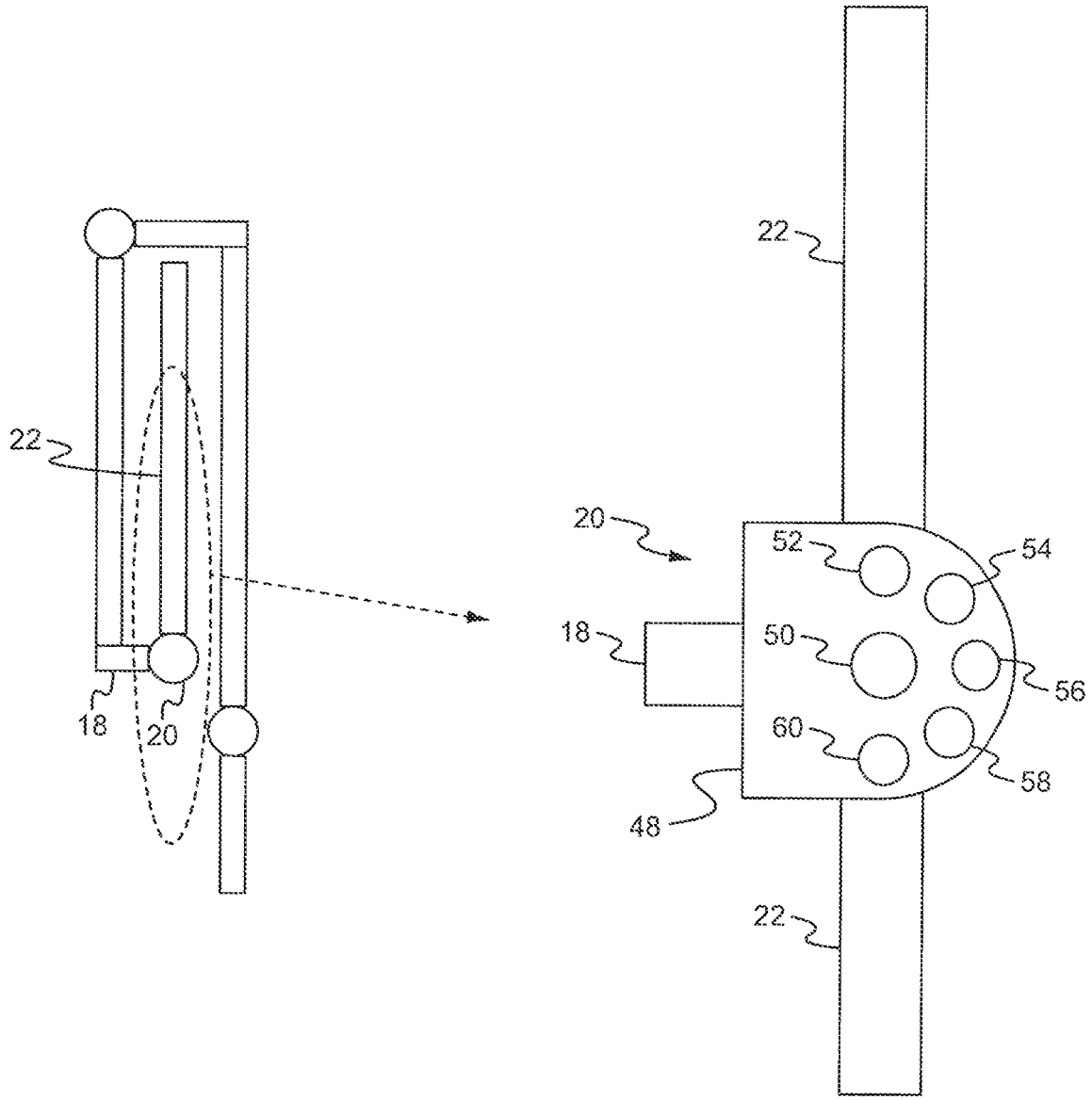
FIG. 15 illustrates a side view of the frame and an expanded view of the hinge assembly used to connect the second frame section to the third frame section according to some embodiments.
Figure 16:
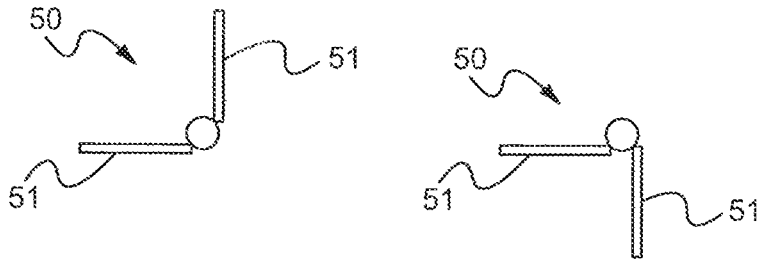
FIG. 16 illustrates an exemplary hinge having two leafs that can be rotated relative to each other.
Figure 17:
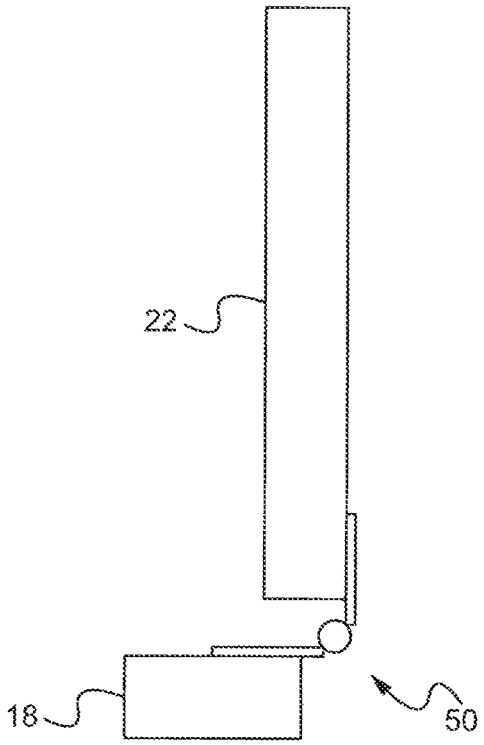
FIG. 17 illustrates the hinge where the third frame section is rotated to the first position.
Figure 18:
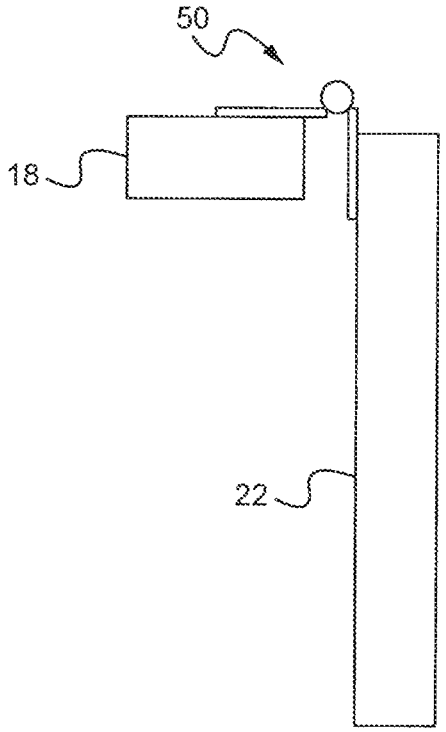
FIG. 18 illustrates the hinge where the third frame section is rotated to the second position.

FIG. 15 illustrates a side view of the frame and an expanded view of the hinge assembly used to connect the second frame section 16 to the third frame section 22 according to some embodiments. FIG. 15 shows two different possible locked positions for the third frame section 22. A first position corresponds to a folded configuration, such as that shown in FIGS. 1-3. The first position corresponds to the upper third frame section 22 shown in the right hand side of FIG. 11. A second position corresponds to an unfolded configuration, such as those shown in FIGS. 3-4. The second position corresponds to the lower third frame section 22 shown in the right hand side in FIG. 11. The exemplary hinge assembly 20 includes a mounting plate 48 and a hinge 50. The hinge 50 enables the third frame section 22 to rotate relative to the mounting frame section 18. The hinge 50 can be configured as any conventional type of hinge that enables such relative movement, such as a barrel hinge that includes a pin, knuckles, and leafs. The mounting plate 48 includes through-holes 52 and 60, which when properly aligned with a corresponding through-hole in the third frame section 22 enable a pin to be inserted to lock the third frame section 22 in the first position or the second position, respectively. The mounting plate 48 includes additional through-holes 54, 56, and 58 to enable the third frame section 22 to be locked into other positions other than the first and second positions. The mounting plate 48 is shown as a semi-circle on one side and a rectangle on the other side. It is understood that alternative configurations can be used. The mounting frame section 18 is fixedly mounted to the mounting plate 48, such as by welding. The hinge 50 is fixedly mounted to the mounting frame section 18 and to the third frame section 22, such as by welding. FIG. 16 illustrates an exemplary hinge having two leafs 51 that can be rotated relative to each other. One leaf 51 can be fixedly mounted to the mounting frame section 18 and the other leaf 51 can be fixedly mounted to third frame section 22. FIG. 17 illustrates the hinge 50 where the third frame section 22 is rotated to the first position. FIG. 18 illustrates the hinge 48 where the third frame section 22 is rotated to the second position.

In some embodiments, the hinge assemblies are configured to provide multiple securing and stabilizing mechanisms. A first mechanism locks the attached frame sections in their proper relative positions, e.g. each frame section has corresponding holes that, when properly aligned, enable a bolt to slide through the aligned holes in each piece, as described above. This bolt can be attached to a spring-loaded mechanism. To enable ease of use, a certain amount of slack is provided using the first mechanism, e.g. the bolt diameter is slightly smaller than the holes in the aligned frame section and hinge assembly. A second mechanism, such as a tensioning clamp, takes up any slack afforded by the first mechanism to form a rigid alignment of the frame section and hinge assembly. The first and second mechanism can be collectively considered a latch, such as latch used in the first second, and third pair of latches previously described.

Figure 27:
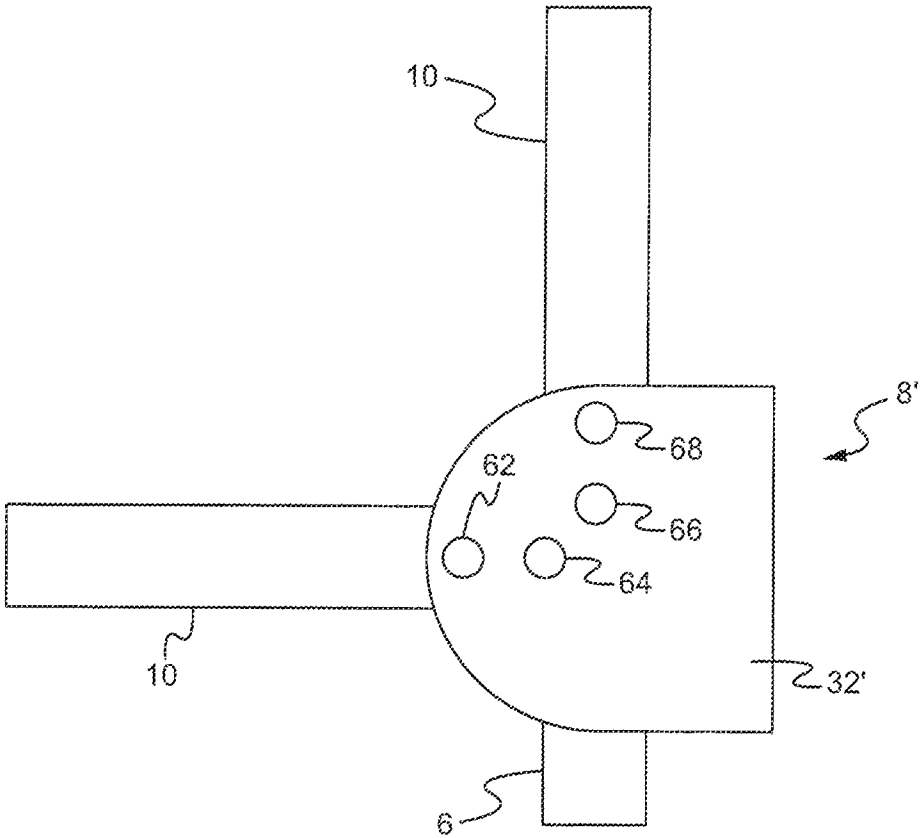
FIG. 27 illustrates a side view of the frame and an expanded view of a hinge assembly used to connect the base platform to the first frame section according to other embodiments.
Figure 27:
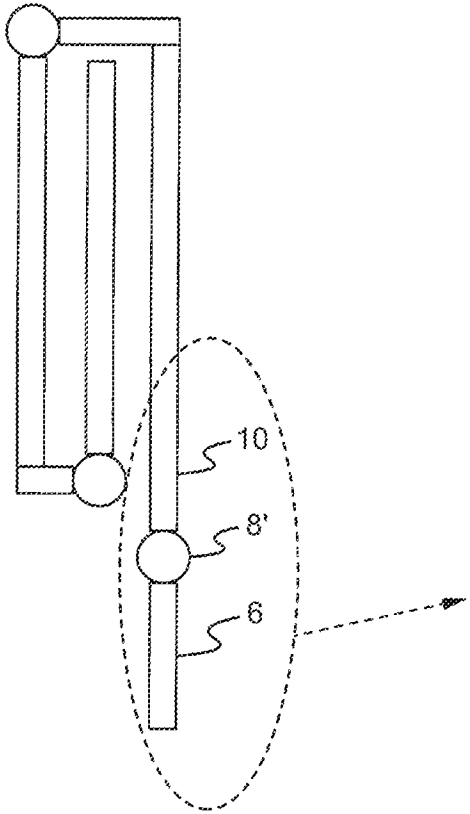

As used herein, a hinge assembly is a structure that enables ends of two frame sections, or the base platform and the first frame section, to be joined together and rotated relative to each other. In the previous embodiments, hinge assemblies are shown that fixedly couple the corresponding frame sections and/or base platform. As previously described, it is understood that alternative hinge assemblies are also contemplated. One such alternative is a hinge assembly that does not utilize a hinge with leafs to which the frame sections/base platform are attached. FIG. 27 illustrates a side view of the frame and an expanded view of a hinge assembly used to connect the base platform to the first frame section according to other embodiments. FIG. 27 shows two different possible locked positions for the first frame section 10. A first position corresponds to the folded configuration, such as that shown in FIG. 1. The first position corresponds to the horizontally aligned first frame section 10 shown in FIG. 27. A second position corresponds to the unfolded configuration, such as those shown in FIGS. 2-4. The second position corresponds to the vertically aligned first frame section 10 shown in FIG. 27. The exemplary hinge assembly 8' includes a mounting plate 32'. The mounting plate 32' is configured to enable the first frame section 10 to rotate relative to the mounting frame section 6. The mounting plate 32' includes through-holes 62-64 and 66-68, which when properly aligned with corresponding through-holes in the first frame section 10 enable pins to be inserted to lock the first frame section in the first position or the second position, respectively. The mounting plate 32' is shown as a semi-circle on one side and a rectangle on the other side. It is understood that alternative configurations can be used. The mounting frame section 6 is fixedly mounted to the mounting plate 32', such as by welding. However, the first frame section 10 is not fixedly coupled, such as welded, to the mounting plate 32'. In this sense, the first frame section 10 can be considered "free-floating" relative to the mounting plate 32'. To change from the first position to the second position the pins in the through-holes 62 and 64 are removed, the first frame section 10 is rotated to the second position, and the pins are inserted into the through-holes 66 and 68. Similar procedure is performed for changing from the second position to the first position. The mounting plate 32' can include channels, slots, sleeves, stops, and/or the like to prevent the ends of the first frame section 10 from separating from the mounting plate 32' while the pins are removed. It is understood that this alternative hinge assembly, or similar, can be used for some or all of the other hinge assemblies in the base structure.

Figure 19A:
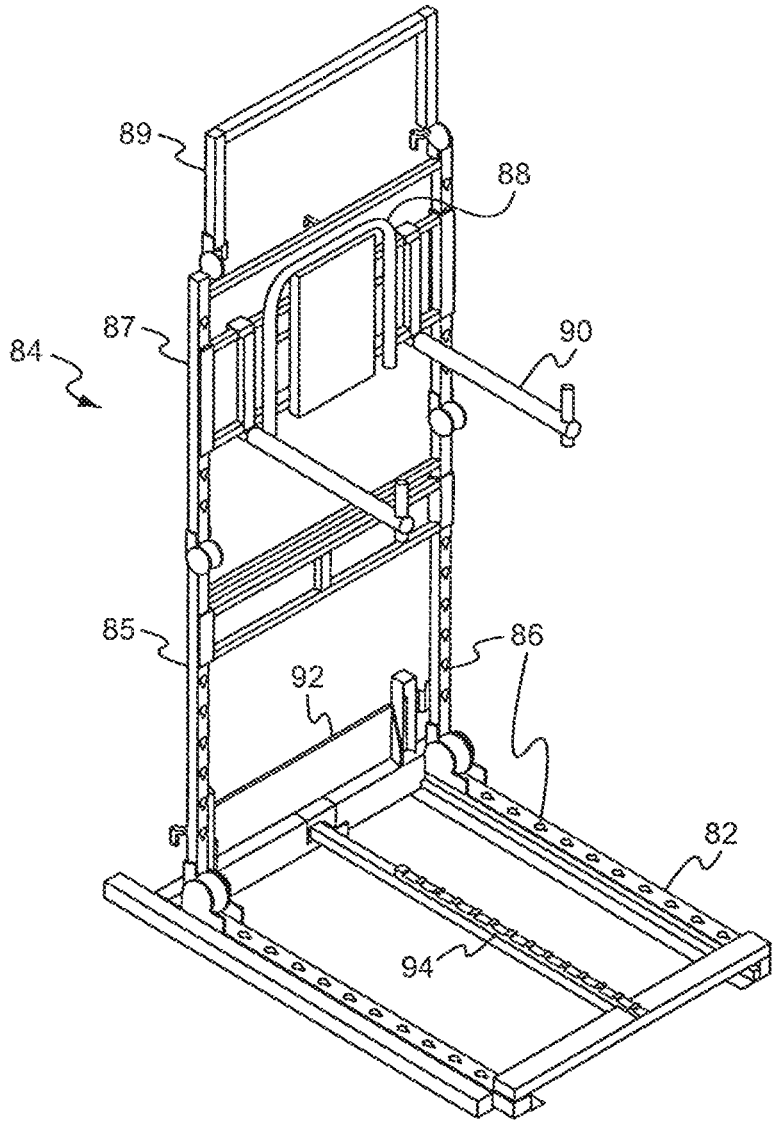
FIGS. 19A-C illustrate perspective views of an exercise equipment in an unfolded configuration according to some embodiments.
Figure 19B:
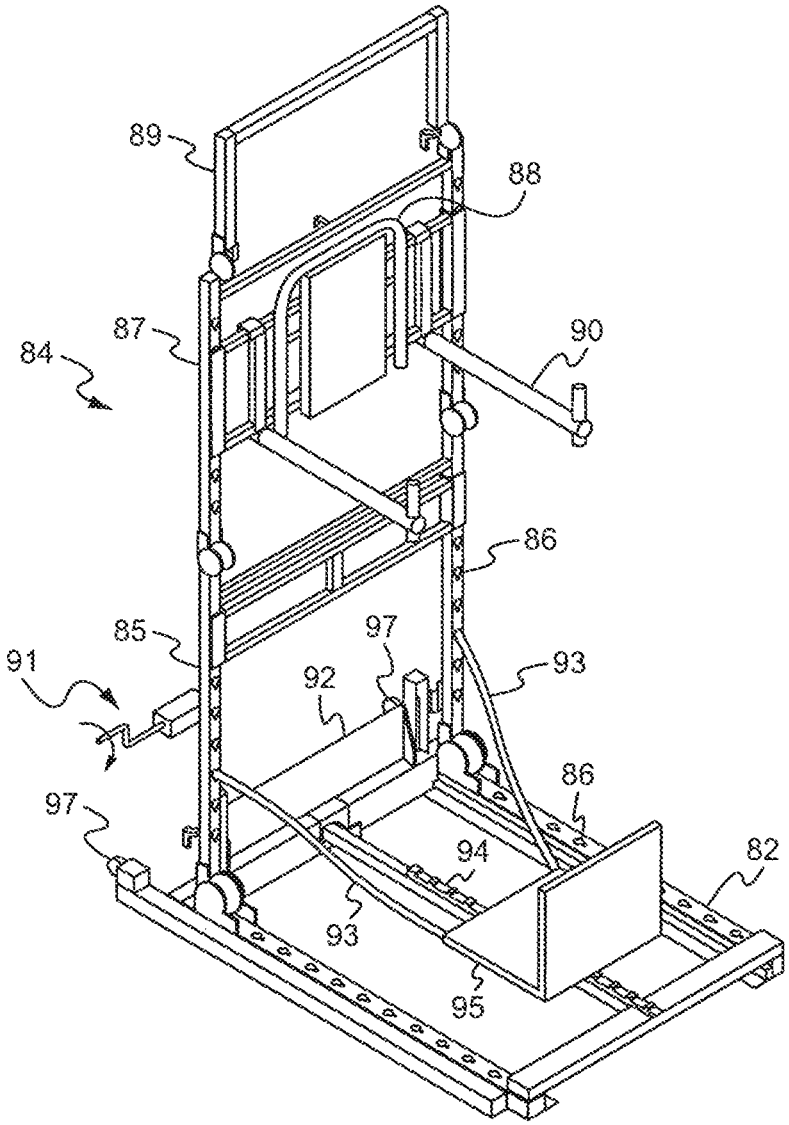
Figure 19C:
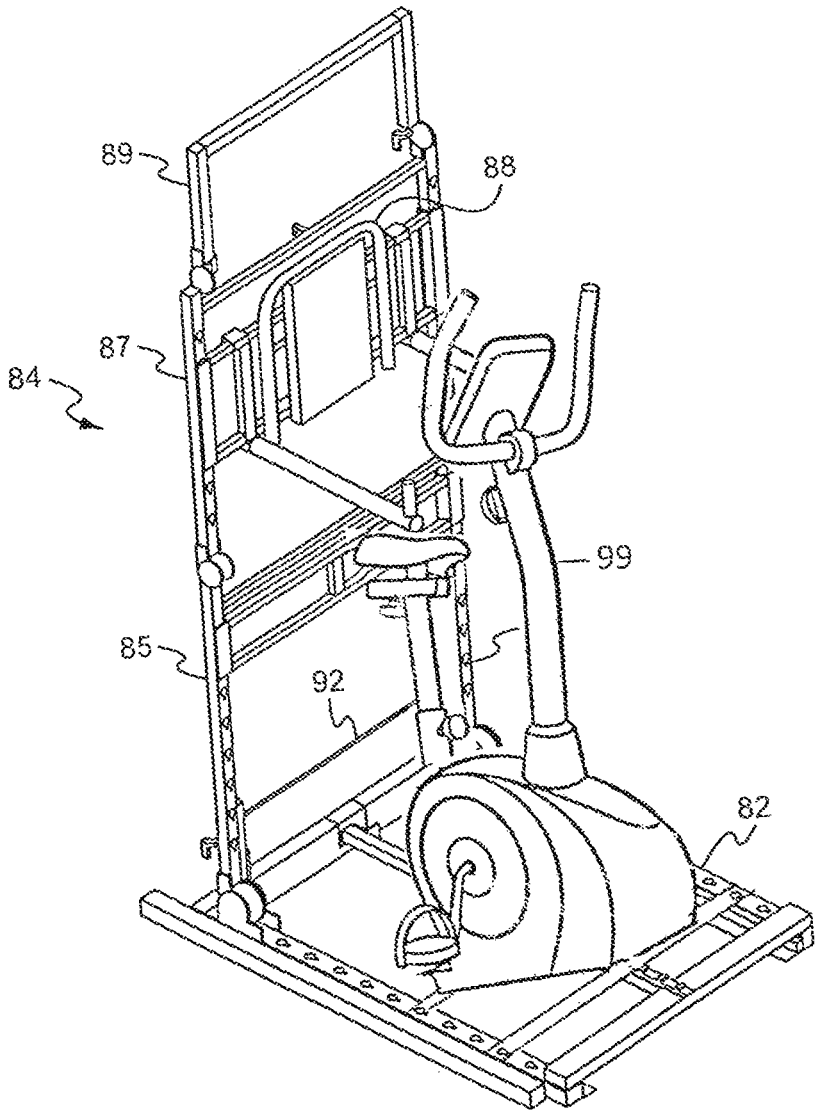

FIGS. 19A-C illustrate perspective views of an exercise equipment in an unfolded configuration according to some embodiments. The exercise equipment shown in FIG. 19A includes a base structure of the type previously described. FIG. 19B shows the exercise equipment in FIG. 19A with a crankshaft 91 and several accessories attached. The base structure includes a base platform 82 and a frame 84. FIG. 19C shows the exercise equipment in FIG. 19A configured with a stationary bike 99. Referring to FIG. 19A, the frame 84 includes a first frame section 85, a second frame section 87, and a third frame section 89. Each of the base platform 82, the first frame section 85, and the second frame section 87 include fastener sites 86. The third frame section 89 can also include fastener sites. In some embodiments, the base platform 82 includes a rigid rail structure positioned around a perimeter of the base platform, with the fastener sites included as part of the rail structure. As shown in FIG. 19A, the base platform 82 has the rigid rail structure formed around three sides of a solid planar substrate. The rigid rail structure is not placed at a fourth side of the solid planar substrate distal from the frame. This enables the solid planar substrate to be slidably moved relative to the rigid rail structure. In other embodiments, the rigid rail structure circumnavigates all four sides of the solid planar substrate. In this alternative case, the rigid rail structure can be configured to enable the solid planar substrate to be slidable. The exercise equipment is also shown in FIG. 19A as having a back rest board accessory 88 attached to the second frame section 87 via multiple fastener sites 86, a footplate accessory 92 attached to the first frame section 85 via multiple fastener sites, and a sliding seat mounting accessory 94 attached to the base platform 82 via multiple fastener sites. Some accessories can also be configured for additional accessories to be mounted. For example, arm bar accessories 90 are attached to the back rest board accessory 88 to perform, for example, leg raises or bar dips. The back rest board accessory can be positioned at lower fastener sites to perform, for example, wall squats. It is understood that more, or less, accessories than those shown in FIG. 19A can be attached to the base structure.

In some embodiments, there is a spring-loading mechanism to assist in folding and unfolding the base structure. The frame sections have sufficient mass to provide stability and rigidity, but the increased weight may result in difficultly folding and unfolding the base structure. A first spring-loaded mechanism, at hinge 8 for example, can be attached to both the base platform and the first frame section to assist in the folding and unfolding process. A second spring-loaded mechanism, at hinge 14 for example, can be attached to both the first frame section and the second frame section for similar assistance. In some embodiments, a crankshaft can be attached to a folded base structure stored in a vertical position that enables the folded base structure to be easily lowered to a horizontal position.

Figure 20:
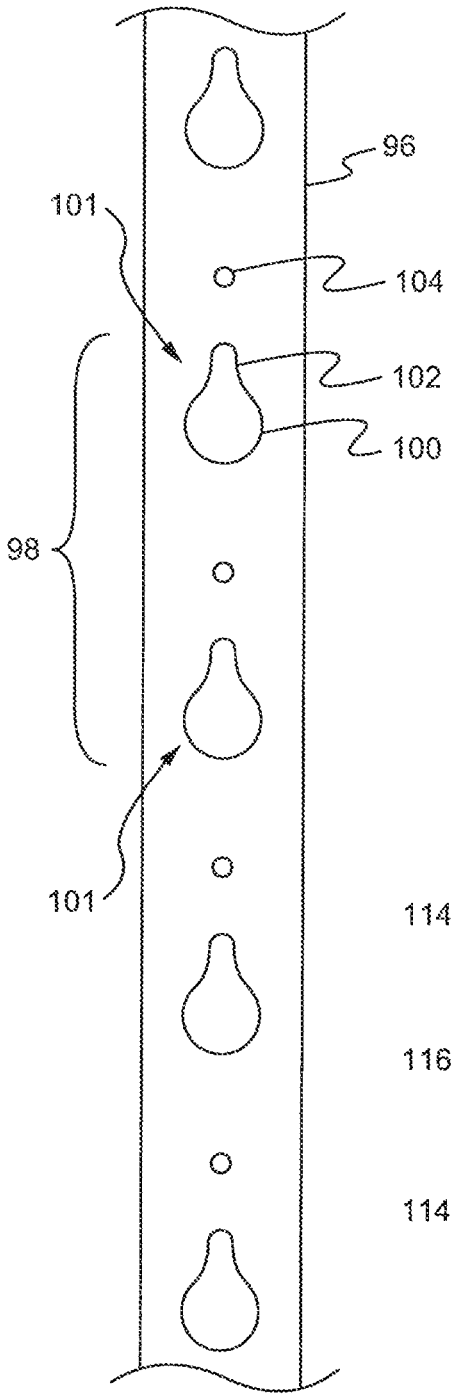
FIG. 20 illustrates a top down view of a section of the base platform or frame including a plurality of exemplary fastener sites according to some embodiments.

The base platform and the frame are each configured with multiple fastener sites, at each of which can be removably attached a fastener. There are a variety of different types of accessories that can be attached to the base structure via the fasteners. In some embodiments, each fastener site includes a slotted opening into which a corresponding fastening protrusion, such as a knob, hook, or the like, of a fastener is fitted and locked into place. Each fastener includes one or more fastening protrusions on one side for mating to the fastener site, and also includes an accessory fastener on an opposing side that enables attachment of an accessory having a complementary fastener element. FIG. 20 illustrates a top down view of a section of the base platform or frame including a plurality of exemplary fastener sites according to some embodiments. The base platform or frame 96 includes multiple fastener sites 98. Each fastener site 98 includes two openings 101 and a screw or pin hole 104. Each opening 101 includes an insert hole 100 for receiving a fastener protrusion and a slot 102 for sliding the received fastener protrusion into a secured position. The screw or pin hole 104 is configured to receive a fastener screw or pin for locking the fastener in the secured position.

Figure 21:
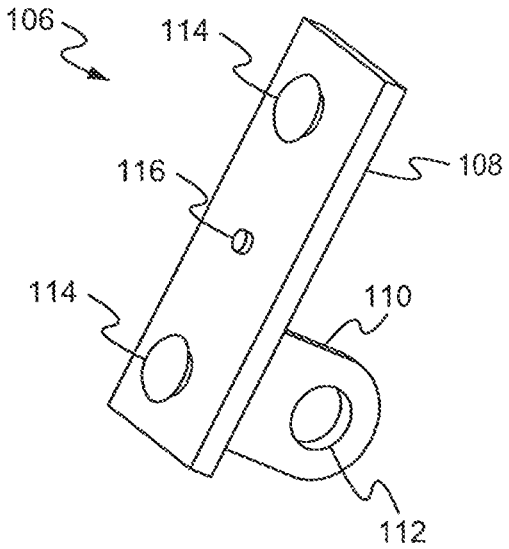
FIG. 21 illustrates a bottom perspective view of an exemplary fastener according to some embodiments.
Figure 22:
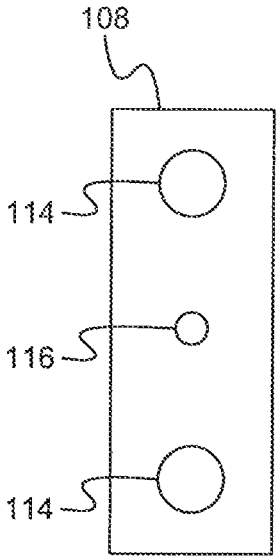
FIG. 22 illustrates a bottom up view of the fastener of FIG. 21.
Figure 23:
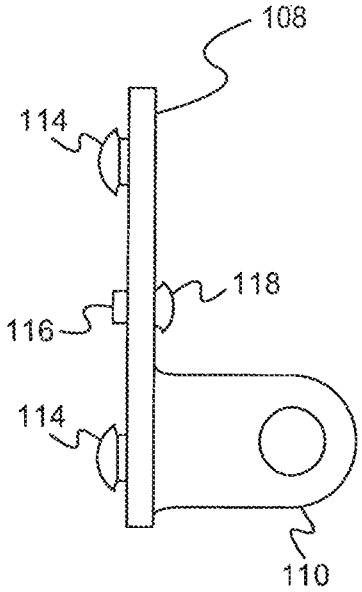
FIG. 23 illustrates a side view of the fastener of FIG. 21.

In an exemplary application, the fastener includes two fastening protrusion knobs and a screw or pin, the two fastening protrusion knobs for sliding into corresponding two slotted openings at a fastener site and the screw or pin for inserting into a corresponding screw or pin hole at the fastener site. The accessory fastener can be, for example, a protrusion with an eye hole opening to which a hook fastener can be attached. Other examples of an accessory fastener include, but are not limited to, an eye bolt or cleat. FIG. 21 illustrates a bottom perspective view of an exemplary fastener according to some embodiments. FIG. 22 illustrates a bottom up view of the fastener of FIG. 21. FIG. 23 illustrates a side view of the fastener of FIG. 21. The fastener 106 is configured to mate with the fastener site 98 of FIG. 20. The fastener 106 includes a fastener base 108 with fastener protrusions 114 and a screw or pin 116 on one side and an accessory fastener 110 on another side. The accessory fastener 110 includes an eye hole 112 enabling connection to an accessory having a complementary attachment means. For example, a resistance band can have a clamp or hook configured to attach at the eye hole 112. The screw or pin 116 includes a screw or pin knob 118 to enable screwing or insertion/removal of the screw or pin 116 into the screw or pin hole 104. It is understood that the accessory fastener 110 can be alternatively configured to mate with other types of accessory attachment configurations. It is also understood that the fastener can be integrally formed as part of the accessory, thereby eliminating the need for an accessory fastener. A fastener can be configured to include or provide coupling means for a pulley. In such configurations, multiple fasteners with pulleys can be attached to the base structure according to desired exercise configurations. In this case, resistance bands can be replaced by cables better adapted to work with pulleys.

A variety of different types of accessories can be attached to the base structure, where each accessory can be attached at one or more fastener sites. Examples types of accessories include resistance bands, cables, chains, bars, and bars in combination with resistance bands, cables, and/or chains. Resistance bands come in various forms and configurations. One can obtain these as off the shelf products. Some have hooks on the end, in which case, these hooks can be used to attach the resistance bands to different positions on the base structure. Cables can be used to extend the reach of the resistance bands so that the proper distance can be maintained by the trainee without having to stretch the resistance bands. The cable in effect becomes an "extender" for the resistance band without having to stretch the resistance band to use it from a proper position on the base structure. Another adaptation is to have a hybrid resistance band where a section closest the user is a high strength cable, rope, or other non-elastic material and the remaining section is elastic, such as a resistance band. This provides an improved degree of safety such that if the resistance band portion were to snap, the user would be protected from the whipping action of the snapping resistance band. Pulleys/rollers can also be added to enable positioning of the resistance band section distal from the user, and positioning the non-elastic section proximate the user. Frame piece with fastener sites accessories can also be fastened to the base platform and/or the frame for additional fastener site positions.

Bars can be attached to the base structure at different fastener sites. The value here is that there are many exercises where one uses the body weight to perform the exercise. Examples are reverse push-ups, push-ups at different angles, pull-ups, etc. The base structure allows multiple connection points for the bar to position the trainee properly for performing these exercises. A bar in combination with resistance bands enables additional types of exercises. For example, reverse lat pulls are enabled by connecting the bar to a resistance band that hangs from the uppermost part of the base structure. A bar, or individual hand holds, can also be indirectly attached to the frame via cable, chain, or other non-elastic element. A slidable seat (e.g., 95, FIG. 19B) can be attached to the base platform or the collapsible frame by resistance bands 93, and a foot rest can be attached to the frame, resistance bands can be connected between the seat and the frame, or the foot rest, to perform seated leg press. The slidable seat and the foot rest are considered accessories attachable to the base structure. The slidable seat can also be used as part of a rowing configuration by further adding an "oar" accessory that can be a movable bar or other handle separately connected to the base structure via one or more resistance bands. In such a rowing configuration, tension bands can or cannot also be separately connected to the slidable seat. A bench press exercise can be performed by positioning a bench on the base platform (does not need to be connected at a fastener site) and attaching a bar to the base structure, e.g. to multiple fastener sites on the base platform, via one or more resistance bands connected at each end of the bar. Fasteners can be configured as barbell supports, such as hooks or racks, to enable the frame to function as a bench press rack, for example. Fasteners can also be configured as a step, which can also function as a seat or bench. As shown in FIG. 19C, the stationary bike 99 can be implemented by attaching a flywheel and seat to the base platform. Other forms of equipment can also be attached. Examples include, but are not limited to, treadmills, stairmaster, etc. In general, the frame and base platform can provide the stability and ability to attach a number of accessories that have moving parts and would normally require a heavy base in order to be stable.

In general, a bar or separate hand holds can be attached to the base platform or frame via one or more resistance bands to perform bench press exercise, incline bench press exercise, seated curl exercise, standing curl exercise, standing face pull exercise, bent over crossover exercise, triceps extension exercise, standing row exercise, leg lift exercise, back leg extension exercise, squat exercise, standing shoulder press exercise, shrug exercise, triceps push down exercise, one-arm triceps push down exercise, kneeling triceps push down exercise, lying triceps extension exercise, hamstring curl exercise, landmine press exercise, bent over row exercise, one-arm row exercise, inverted row exercise, dead lift exercise, triceps push down exercise, lateral raise exercise, face pull exercise, incline YTW exercise, shoulder shrug exercise, lat pull down exercise, overhead press exercise, clean and press exercise, incline bench press exercise, dumbbell curl exercise, hammer curl exercise, cross-body curl exercise, hang clean exercise, lunge exercise, Pilate exercises, torso twist exercise, banded and the like.

Examples of exercises that can be performed using non-elastic alternatives to the resistance bands include, but are not limited to, cable bent-over row exercise, good morning exercise, and a variety of body weight exercises including, but not limited to, fly exercise, reverse fly exercise, row exercise, assisted pushup exercise, and TRX pushups. Examples of exercises that can be used with the attached step (seat, bench) include, but are not limited to, assisted pushups with attached bench, triceps dip exercise on attached bench, stretching exercises, step up/down exercises, leg extension exercise with attached bench, and seated leg curls.

Figure 25:
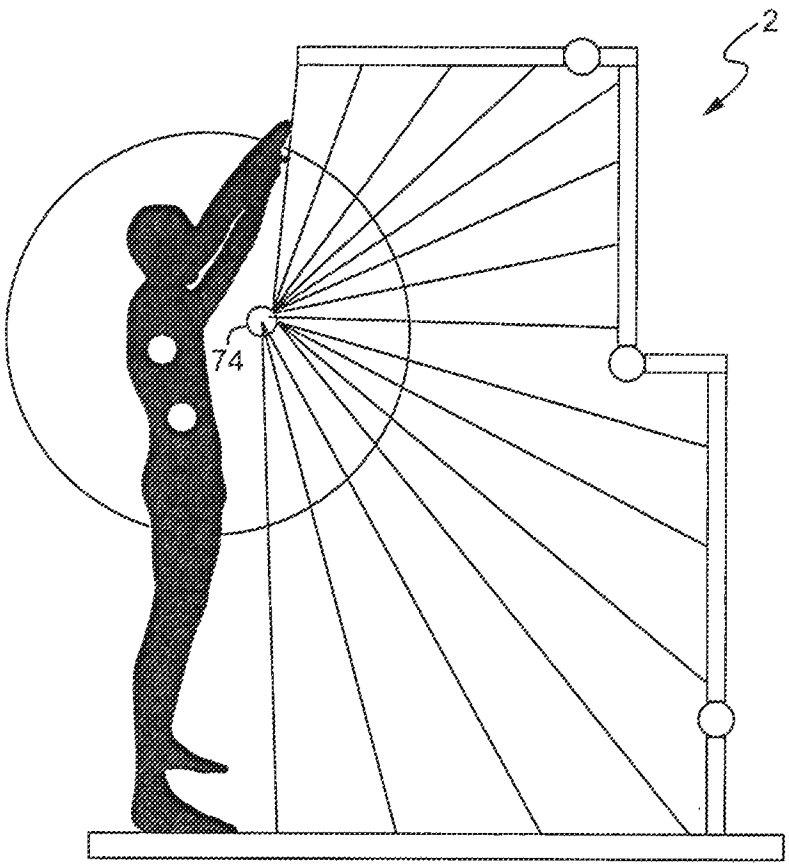
FIG. 25 illustrates various different exemplary attachment positions of resistance bands to the base structure according to an alternative accessory starting point.
Figure 24:
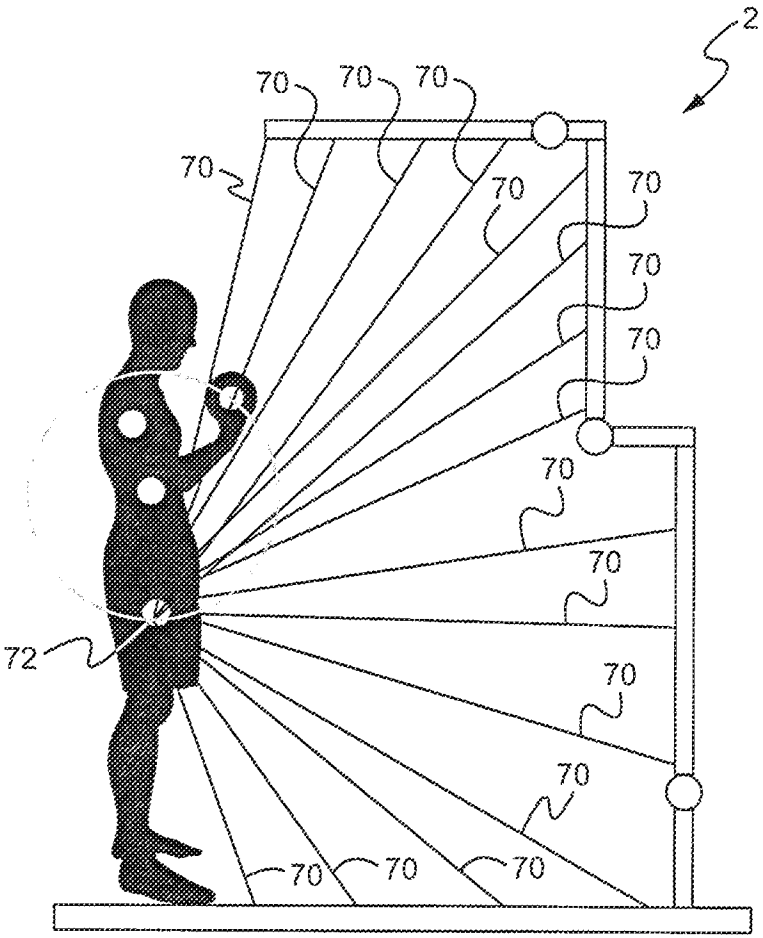
FIG. 24 illustrates various different exemplary attachment positions of resistance bands to the base structure for an accessory starting point.

Since there are numerous fastener sites along the base platform and the frame, the attachment position of the accessories can be custom adjusted by the user. In some embodiments, the resistance bands can be length-adjustable to accommodate a desired range of motion and tension. FIG. 24 illustrates various different exemplary attachment positions of resistance bands 70 to the base structure 2. Assuming a starting exercise position at point 72, one or more resistance bands can be attached to the base structure 2 for performing a variety of different exercise motions and corresponding resistance. The types of resistance bands and attachment position(s) can be adapted depending on the starting position and type of exercise performed, such as alternative starting position 74 shown in FIG. 25. Multiple tension bands can be simultaneously attached between the base structure and an accessory, such as a bench press bar, at different angles to achieve multi-directional force and/or different resistance profiles.

The use of resistance bands enable the implementation of multi-directional force vectors, e.g multiple resistance bands attached to an accessory at different angles (all bands attached to the accessory at one end, but each different band is attached to a different fastener site). Multi-directional force vectors can be used to create exercises with new resistance angles relative to the body. Additionally, multi-directional force vectors can be used to increment/decrement the resistance force for the user performing the exercise in more precise resistance units due to the composite resistance force formed by the multiple different directions of the individual force vectors of each tension band. Pulleys or rollers can be used, e.g. a pulley/roller positioned at a first fastener site on the base platform, with the resistance band extending under the pulley/roller and then extending horizontally to be connected at another second fastener site. The position of the pulley fastener site can be adjusted to adjust the overall length between the first end of the resistance band connected to the exercise accessory, e.g. bench press bar, and the second end attached to the second fastener site. Lengthening the resistance band increases the resistance for the user performing the exercise, shortening the resistance band decreases the resistance.

Cams can also be used as accessories. Cams can have different types of profiles, each profile defining a force resistance profile for a cable wrapped about the cam profile with the cable attached to a resistance band. Similarly, there are motors that provide similar such force resistance profiles. As one example, shown in FIG. 26, a motor 3 can be adapted for attachment at the fastener sites, with a cable 5, having a handle 5A, extending from the motor 3 to be attachable to the motor 3, either directly or via one or more pulleys/rollers. The motor 3 regulates the torque, which in turn regulates the resistance experienced by the user.

Figure 26:
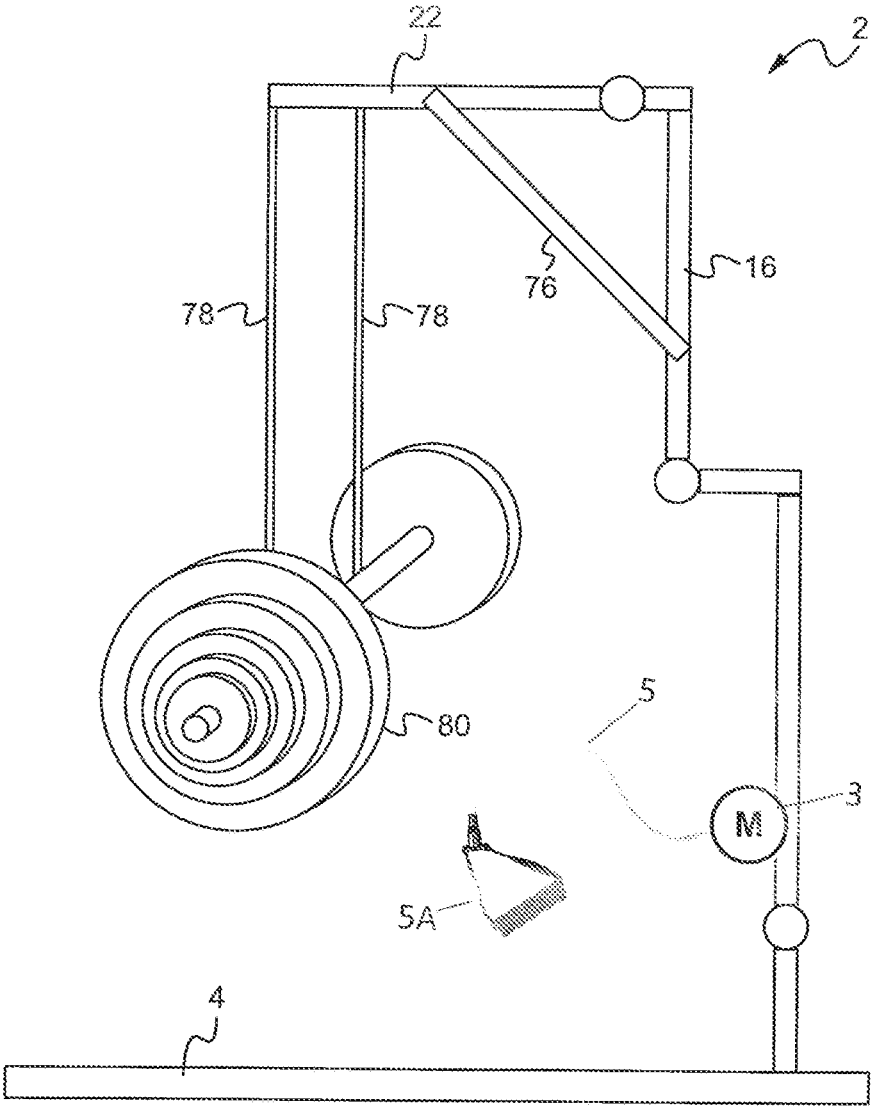
FIG. 26 illustrates the base structure with additional support member accessories according to some embodiments.

Accessories also can include additional support members for the base structure. FIG. 26 illustrates the base structure with additional support member accessories according to some embodiments. Support members 76 are connected between the frame section 16 and the frame section 22 and provide more weight bearing capability to the frame section 22. This additional support allows, for example, a heavier person to do pull-ups. With the additional support members 76 in place, the frame section 22 can also be fitted with support cords 78 of a pre-determined length that can be attached to a set of weights 80 that are being used for a military bench press, for example. The support cords can be adjusted in a manner that prevents the weights from pressing too hard on the chest of the weight-lifter. It is understood that alternatives to cords can be used including, but not limited to, chains, cables, or other non-elastic elements. Parallel vertical bars can be attached the frame section 22 and/or the base platform 4 to guide the weight set in a vertical direction movement. The additional support members can also be configured with fastener sites to further function as frame piece with fastener sites accessories.

The base structure provides a starting point for a modular system where each accessory can be considered a module that can be attached to the base structure. This provides flexibility to the user to only purchase those accessories they are interested in, as opposed to buying a integrated system that includes multiple features that may or may not be desirable to the user.

The present invention has been described in terms of specific embodiments incorporating details to facilitate the understanding of the principles of construction and operation of the exercise equipment. Such references, herein, to specific embodiments and details thereof are not intended to limit the scope of the claims appended hereto. It will be apparent to those skilled in the art that modifications can be made in the embodiments chosen for illustration without departing from the spirit and scope of the invention.

What is claimed is:

1. Exercise equipment comprising:

a. a base platform comprising a plurality of base platform fastener sites configured for attaching an exercising accessory to the base platform;

b. a plurality of base platform hinge assemblies coupled to an end of the base platform; and c. a collapsible frame coupled to the base platform hinge assemblies, wherein the collapsible frame comprises a plurality of frame sections and a plurality of frame fastener sites configured for attaching the exercising accessory to the collapsible frame, each of the plurality of frame sections comprising a plurality of spaced-apart vertical support members, wherein, in a plane, the plurality of frame sections are configured to rotate relative to each other to collapse and expand the frame, and the plurality of base platform hinge assemblies are configured to move the collapsible frame and the base platform relative to each other and between a folded configuration for storage of the exercise equipment and an unfolded configuration for performing exercises by a user.

2. The exercise equipment of claim 1 wherein the base platform comprises a planar substrate configured to lie on a flat surface.

3. The exercise equipment of claim 2 wherein the base platform comprises rigid rail structure positioned along a perimeter of the planar substrate.

4. The exercise equipment of claim 3 wherein the rigid rail structure is positioned along three sides of the planar substrate.

5. The exercise equipment of claim 3 wherein the rigid rail structure circumnavigates an entire perimeter of the planar substrate.

6. The exercise equipment of claim 3 wherein the base platform fastener sites are formed in the rigid rail structure.

7. The exercise equipment of claim 1 wherein the plurality of frame sections are interconnected by a plurality of frame hinge assemblies.

8. The exercise equipment of claim 7 wherein the plurality of frame hinge assemblies are configured to move the frame sections relative to each other and between the folded configuration and the unfolded configuration, wherein in the folded configuration the plurality of frame sections are folded upon each other.

9. The exercise equipment of claim 7 wherein the plurality of frame sections comprise a first frame section coupled to the base platform via the plurality of base platform hinge assemblies, a second frame section coupled to the first frame section via a first subset of the plurality of frame hinge assemblies, and a third frame section coupled to the second frame section via a second subset of the plurality of frame hinge assemblies.

10. The exercise equipment of claim 9 wherein in the unfolded configuration the first frame section and the second frame section are perpendicular to the base platform, and the third frame section is one of either perpendicular to the base platform, parallel to the base platform, or angled to the base platform.

11. The exercise equipment of claim 10 further comprising a support member configured to attach to a fastener site on the third frame section and a fastener site of the second frame section when the third frame section is positioned either perpendicular to the base platform or angled to the base platform.

12. The exercise equipment of claim 1 wherein the exercising accessory is attached to either the base platform via one or more of the plurality of base platform fastener sites, the collapsible frame via one or more of the plurality of frame fastener sites, or both the base platform via one or more of the plurality of base platform fastener sites and the collapsible frame via one or more of the plurality of frame fastener sites.

13. The exercise equipment of claim 1 further comprising a fastener configured to removably fasten and unfasten at each of the plurality of fastener sites, wherein the fastener includes a first fastener element configured to mate with a complementary fastener element at the fastener site and a second fastener element configured to mate with a complementary fastener element on the exercising accessory.

14. The exercise equipment of claim 13 wherein an attachment position of the exercising accessory on the base platform is adjustable by selectively attaching the fastener to one of the plurality of base platform fastener sites.

15. The exercise equipment of claim 13 wherein an attachment position of the exercising accessory on the collapsible frame is adjustable by selectively attaching the fastener to one of the plurality of frame fastener sites.

16. The exercise equipment of claim 1 further comprising a fastener configured to removably fasten and unfasten at each of the plurality of fastener sites, wherein the fastener includes a first fastener element configured to mate with a complementary fastener element at the fastener site and a pulley.

17. The exercise equipment of claim 1 further comprising a plurality of wheels coupled to the base platform, wherein in the unfolded configuration the wheels do not contact the ground, and in the folded configuration the wheels enable the exercise equipment to be moved to a storage location.

18. The exercise equipment of claim 1 further comprising a crankshaft coupled to the base platform that when positioned in a vertical storage position enables the folded base platform to be lowered to a horizontal position.

19. The exercise equipment of claim 1 wherein the exercising accessory comprises a resistance band.

20. The exercise equipment of claim 1 wherein the exercising accessory comprises a back rest.

21. The exercise equipment of claim 1 wherein the exercising accessory comprises a back rest with arm bars.

22. The exercise equipment of claim 1 wherein the exercising accessory comprises a stationary bike.

23. The exercise equipment of claim 1 further comprising a plurality of exercising accessories, each one of the plurality of exercising accessories attached to either the base platform via one or more of the plurality of base platform fastener sites, the collapsible frame via one or more of the plurality of frame fastener sites, or both the base platform via one or more of the plurality of base platform fastener sites and the collapsible frame via one or more of the plurality of frame fastener sites.

24. The exercise equipment of claim 23 wherein the plurality of exercising accessories comprise a plurality of resistance bands, further comprising a moveable element coupled to the plurality of resistance bands.

25. The exercise equipment of claim 24 wherein the plurality of resistance bands are attached at different angles to the moveable element to enable multi-directional force vectors applied to the moveable element.

26. The exercise equipment of claim 24 wherein the moveable element comprises a bar or a slidable seat.

27. The exercise equipment of claim 1, wherein the exercise accessory comprises a motor and a cable, wherein the motor couples the cable to one of the plurality of base platform fastener sites and the plurality of frame fastener sites, and wherein the motor is configured to regulate a resistance experienced by the user pulling the cable.

28. The exercise equipment of claim 1 wherein adjacent spaced-apart support members are coupled by a corresponding horizontal support.

29. The exercise equipment of claim 1 wherein adjacent spaced-apart support members are coupled by corresponding cross bars.

30. The exercise equipment of claim 1 further comprising a plurality of support cords and a set of weights, wherein a first frame section of the plurality of frame sections is secured at an angle to a second frame section of the plurality of frame sections, the second frame section coupled by the support cords to the set of weights positioned above a surface of the base platform.

31. The exercise equipment of claim 30 further comprising a plurality of angled support members securing the first frame section to the second frame section at the angle.

32. Exercise equipment comprising:

a. a base platform comprising a plurality of base platform fastener sites configured for attaching an exercising accessory to the base platform, wherein the base platform comprises a planar substrate configured to lie on a flat surface and a rigid rail structure positioned along a perimeter of the planar substrate;

b. a plurality of base platform hinge assemblies coupled to an end of the base platform; and c. a collapsible frame coupled to the base platform hinge assemblies, wherein the collapsible frame comprises a plurality of frame fastener sites configured for attaching the exercising accessory to the collapsible frame, wherein the plurality of base platform hinge assemblies are configured to move the collapsible frame and the base platform relative to each other and between a folded configuration for storage of the exercise equipment and an unfolded configuration for performing exercises by a user.

33. Exercise equipment comprising:

a. a base platform comprising a plurality of base platform fastener sites configured for attaching an exercising accessory to the base platform;

b. a plurality of base platform hinge assemblies coupled to an end of the base platform; and c. a collapsible frame coupled to the base platform hinge assemblies, wherein the collapsible frame comprises a plurality of frame sections coupled by joints and a plurality of frame fastener sites configured for attaching the exercising accessory to the collapsible frame, and each of the plurality of frame sections comprises a plurality of spaced-apart support members, wherein the exercise equipment is collapsible in stages comprising bending the collapsible frame at the joints and bending the base platform relative to one or more of the base platform hinge assemblies, thereby changing the exercise equipment between a folded configuration for storage and an unfolded configuration for performing exercises by a user.

34. The exercise equipment of claim 33 wherein when the exercise equipment is in the unfolded configuration, one or more of the plurality of spaced-apart support members are substantially perpendicular to a surface of the base platform, substantially parallel to the surface of the base platform, or both.

35. The exercise equipment of claim 33 further comprising a plurality of support cords and a set of weights, wherein a first frame section of the plurality of frame sections is secured at an angle to a second frame section of the plurality of frame sections, the second frame section coupled by the support cords to the set of weights positioned above a surface of the base platform.

36. The exercise equipment of claim 35 further comprising a plurality of angled support members securing the first frame section to the second frame section at the angle.

37. Exercise equipment comprising:

a. a base platform comprising a plurality of base platform fastener sites for attaching an exercising accessory to the base platform;

b. a plurality of base platform hinge assemblies coupled to an end of the base platform; and c. a collapsible frame coupled to the base platform hinge assemblies at a first end of the exercise equipment, a sagittal plane corresponding to a user configured to be positioned on the base platform directly facing the first end of the exercise equipment, wherein the collapsible frame comprises a plurality of frame fastener sites arranged in a first plane parallel to the sagittal plane and configured for attaching the exercising accessory to one of the plurality of frame fastener sites at different angles about a point in the first plane to enable implementation of multi-directional force vectors, wherein the plurality of base platform hinge assemblies are configured to move the collapsible frame and the base platform relative to each other and between a folded configuration for storage of the exercise equipment and an unfolded configuration for performing exercises by a user.

38. The exercise equipment of claim 37 wherein the exercising accessory comprises a plurality of resistance bands removably coupled to the plurality of frame fastener sites.

* * * * *